US006342863B2

(12) United States Patent
Kitamori et al.

(10) Patent No.: US 6,342,863 B2
(45) **Date of Patent: *Jan. 29, 2002**

(54) ANTENNA APPARATUS AND ANTENNA AND TRANCEIVER USING THE SAME

(75) Inventors: Nobumasa Kitamori, Nagaokakyo; Kazutaka Higashi, Hirakata, both of (JP)

(73) Assignee: Murata Manufacturing Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/429,468

(22) Filed: Oct. 28, 1999

(30) Foreign Application Priority Data

Oct. 28, 1998 (JP) ..... 10-306936

(51) Int. Cl.[7] ..... H01Q 13/10
(52) U.S. Cl. ..... 343/767; 343/911 R; 343/700 MS
(58) Field of Search ..... 343/767, 700 MS, 343/702, 785, 911 R, 769, 753; H01Q 13/10

(56) References Cited

U.S. PATENT DOCUMENTS 4,775,866 A * 10/1988 Shibata et al. ..... 343/700 MS
6,008,771 A * 12/1999 Tanaka et al. ..... 343/767
6,052,087 A * 4/2000 Ishikawa et al. ..... 343/700 MS

FOREIGN PATENT DOCUMENTS

EP 0743697 11/1996
EP 0817394 1/1998

OTHER PUBLICATIONS

Japanese Abstract vol. 1997 No. 05, May 30, 1997 & JP 09 008542 A (Matsushita Electric Independent Co LTD). Jan. 10, 1997.

Izumi Uchida et al.: Miniaturization of 35–GHZ NRD–Guide Transmitters and Receiver Electronics, US, Scripta Technic. vol. 77, No. 2.

* cited by examiner

*Primary Examiner*—Don Wong
*Assistant Examiner*—Trinh Vo Dinh
(74) *Attorney, Agent, or Firm*—Ostrolenk, Faber, Gerb & Soffen, LLP

(57) ABSTRACT

An antenna apparatus includes two substantially parallel conductor plates, a dielectric strip held between the two conductors, an aperture formed on the upper conductor plate above the dielectric strip, and a matching section for matching impedance between the dielectric strip and the aperture. The matching section is integrated with the dielectric strip below the aperture, thus continuously connecting the matching section to the dielectric strip.

26 Claims, 6 Drawing Sheets

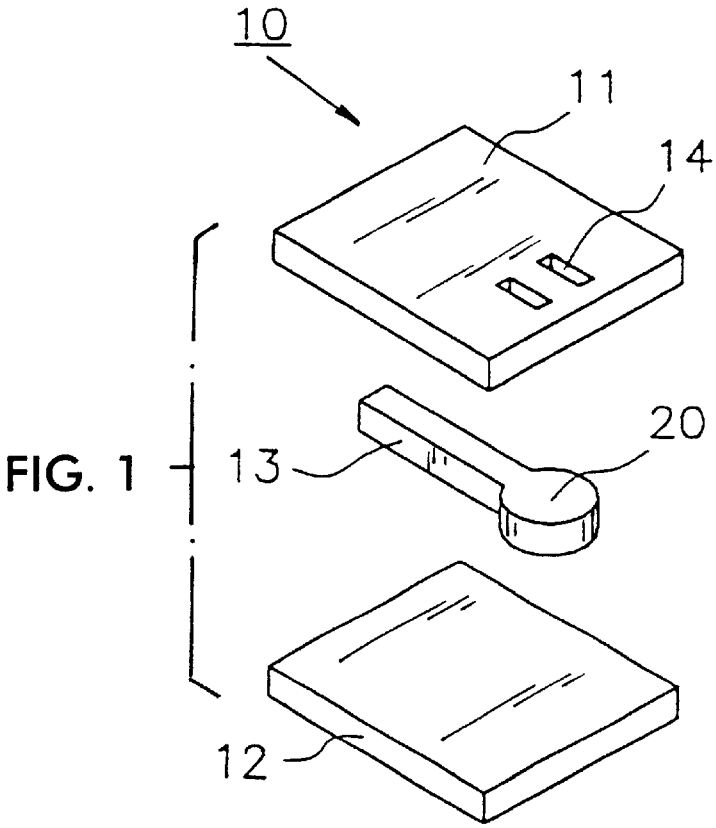
FIG. 1
FIG. 2
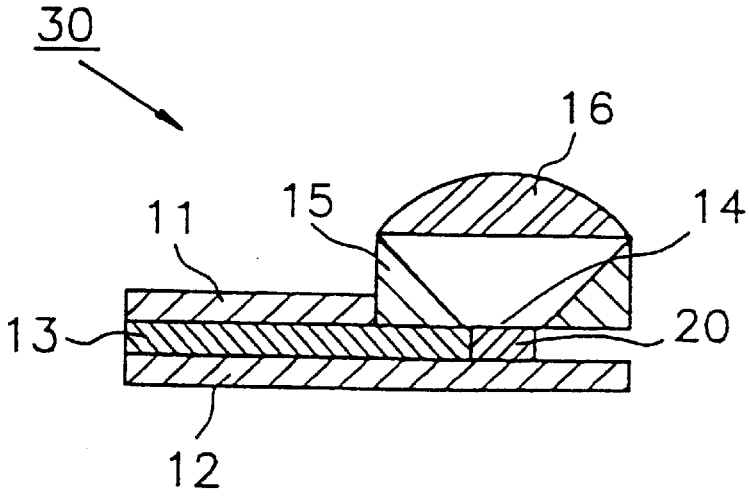

FIG. 5A
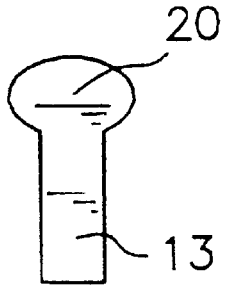
FIG. 5B
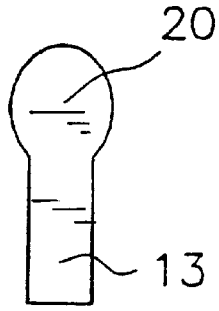
FIG. 6A
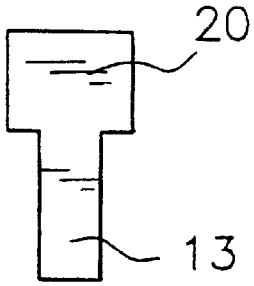
FIG. 6B
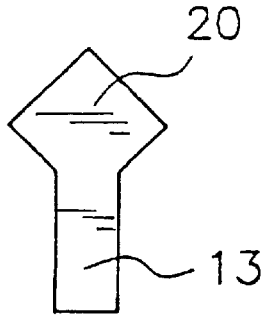
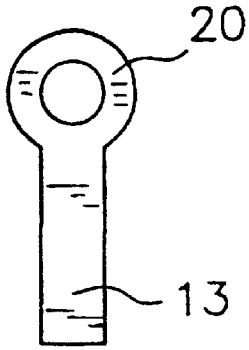
FIG. 7

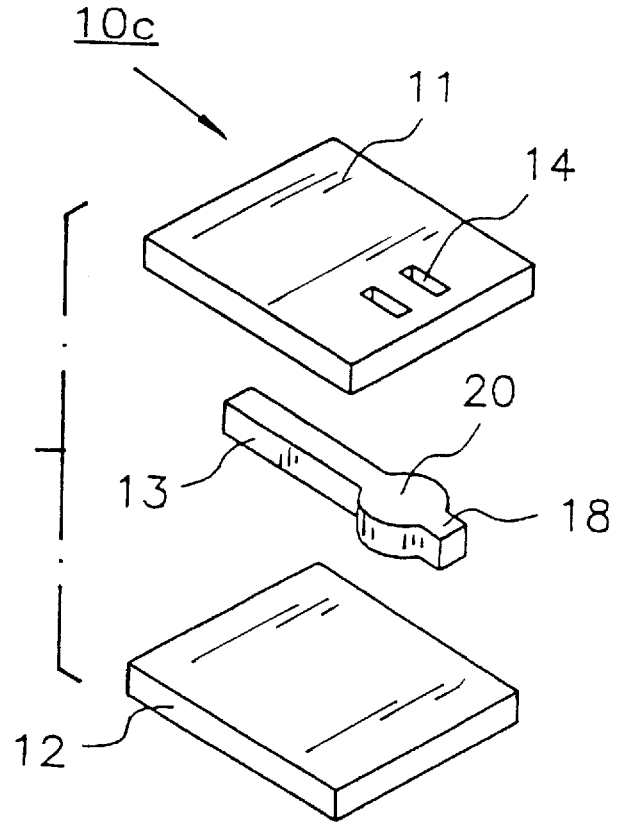
FIG. 8
FIG. 9
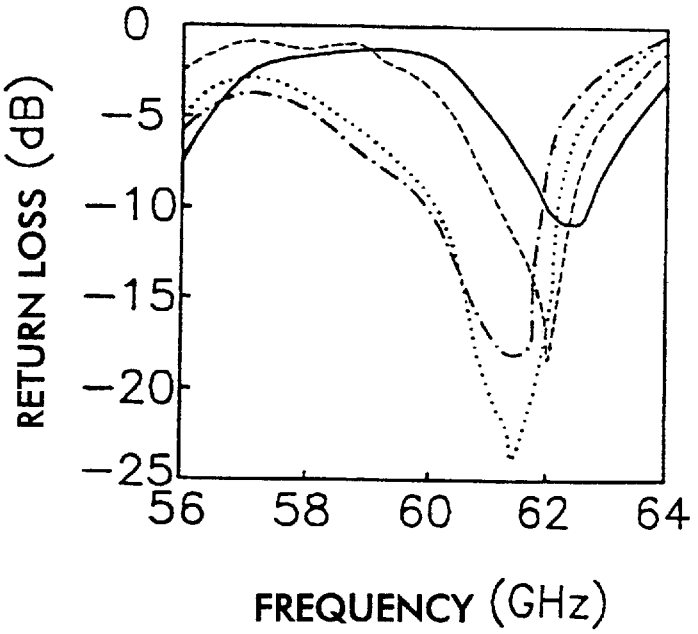

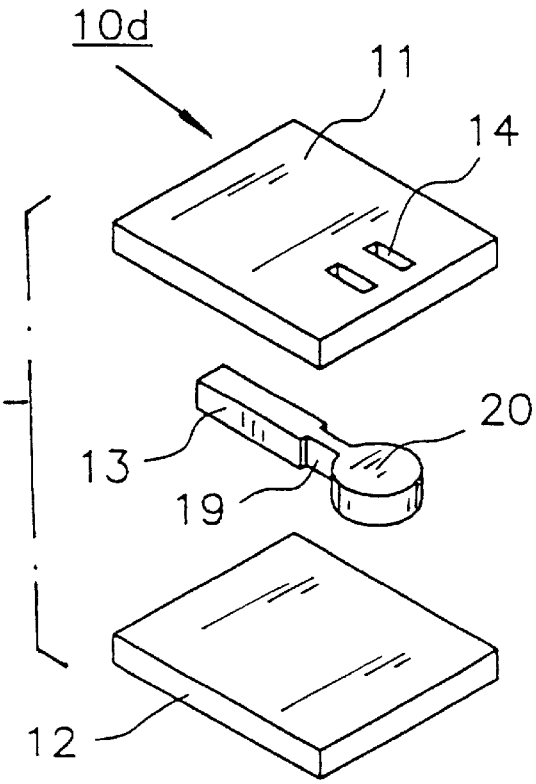
FIG. 10
FIG. 11A
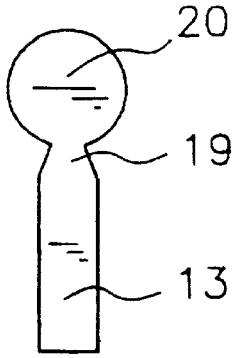
FIG. 11B
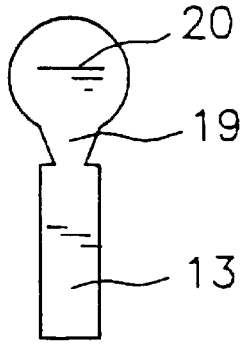
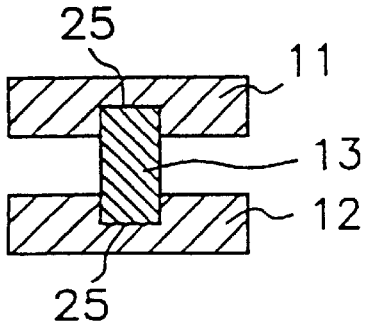
FIG. 12

ANTENNA APPARATUS AND ANTENNA AND TRANCEIVER USING THE SAME

BACKGROUND OF THE INVENTION

1. Field of the Invention

The present invention relates to antenna apparatus used in an automatic driving system for automobiles and the like. More particularly, the present invention relates to an antenna apparatus using a nonradiative dielectric waveguide using a high frequency band such as the milliwave band.

2. Description of the Related Art

A known antenna apparatus is described with reference to FIG. 14. FIG. 14 is an exploded perspective view of the known antenna apparatus.

Referring to FIG. 14, a known antenna apparatus 110 includes an upper conductor plate 111 and a lower conductor plate 112 made of aluminum, a dielectric strip 113 made of polytetrafluoroethylene, which is held between the upper conductor plate 111 and the lower conductor plate 112, and a cylindrical dielectric resonator 127 disposed at a distance from an end of the dielectric strip 113. A two-slot aperture 114 is formed on the upper conductor plate 111 at a position where the dielectric resonator 127 is disposed.

With this configuration, a nonradiative dielectric waveguide is formed by the upper conductor plate 111, the lower conductor plate 112, and the dielectric strip 113. By adjusting the distance between the upper conductor plate 111 and the lower conductor plate 112 to half a propagating wavelength or less, only the dielectric strip 113 operates as a signal propagation area. An electromagnetic wave input from the outside is propagated through the dielectric strip 113 in a longitudinal-section magnetic (LSM) mode, which in turn is connected with the dielectric resonator 127. The dielectric resonator 127 resonates in an $HE_{111}$ mode. The electromagnetic wave is radiated from the dielectric resonator 127 via the aperture 114 on the upper conductor plate 111.

Recently, a high frequency band, such as the milliwave band, has been used for automatic driving systems for automobiles. Accordingly, there is an increasing demand for high accuracy in the antenna apparatus, such as by miniaturization of the dielectric resonator. However, the known antenna apparatus includes the dielectric strip and the dielectric resonator disposed at a predetermined separation in accordance with an operating frequency. Disposition of the dielectric resonator in order to satisfy the required characteristics is very difficult.

Polytetrafluoroethylene employed for the dielectric strip has a relatively large coefficient of linear expansion. Variations in temperature cause variations in the distance between the dielectric strip and the dielectric resonator, thus failing to match the operating frequency and increasing return loss. Specifically, the distance between the dielectric strip and the dielectric resonator is small in the milliwave band, so that slight variations in the distance exert a powerful influence on the characteristics of the antenna apparatus.

SUMMARY OF THE INVENTION

Accordingly, it is an object of the present invention to provide an antenna apparatus, and an antenna and a transceiver using the same, in which disposition of component parts including a dielectric strip is simple, and characteristics of the antenna apparatus are not susceptible to temperature variations even in a high frequency band, e.g., in the milliwave band.

To this end, according to an aspect of the present invention, there is provided an antenna apparatus including two substantially parallel conductors, a dielectric strip held between the two conductors, an aperture formed on one of the two conductors in the vicinity of the dielectric strip, and a matching section for matching impedance between the dielectric strip and the aperture. The matching section is continuously connected to the dielectric strip in the vicinity of the aperture.

Electromagnetic waves are radiated from the matching section continuously connected to the dielectric strip. There is no need to dispose a dielectric resonator at a distance from the dielectric strip, as in known antenna apparatus. In the antenna apparatus of the present invention, the dielectric strip and the matching section are integrated, eliminating detailed working to dispose the dielectric strip and the dielectric resonator at a predetermined separation. The antenna apparatus of the present invention is stable in characteristics relative to temperature variations.

A stub formed of a dielectric may be continuously connected to the matching section. Thus, reflection characteristics of the antenna apparatus may be improved.

The stub may have a length of $\frac{1}{4}\lambda g$ where $\lambda g$ represents a propagating wavelength. Thus, the reflection characteristics of the antenna apparatus are optimized.

A connecting dielectric strip having a sectional shape differing from that of the dielectric strip may be continuously connected in the vicinity of the matching section. Variations in the shape of the connecting dielectric strip permit variations in an amount of connection between the dielectric strip and the matching section, thereby adjusting the matching between the dielectric strip and the matching section.

The connecting dielectric strip may have a length of $\frac{1}{4}\lambda g$ relative to the propagating wavelength $\lambda g$. Thus, the amount of connection and the matching between the dielectric strip and the matching section are optimized.

In accordance with another aspect of the present invention, there is provided an antenna including the antenna apparatus and a dielectric lens disposed in the upper part of the aperture of the antenna apparatus.

In accordance with another aspect of the present invention, there is provided a transceiver including the antenna and a transceiver circuit connected to the antenna.

Accordingly, productivity is increased, and the antenna and the transceiver with stable characteristics relative to temperature variations are obtained.

Other features and advantages of the present invention will become apparent from the following description of the invention which refers to the accompanying drawings.

BRIEF DESCRIPTION OF THE DRAWING

FIG. 1 is an exploded perspective view of an antenna apparatus according to a first embodiment of the present invention;

FIG. 2 is a sectional view of an antenna of the present invention;

FIGS. 5A and 5B are plan views of the antenna apparatus of the present invention illustrating forms of other matching sections;

FIGS. 6A and 6B are plan views of the antenna apparatus of the present invention illustrating forms of other matching sections;

FIG. 7 is a plan view of the antenna apparatus of the present invention illustrating a form of another matching section;

FIG. 8 is an exploded perspective view of an antenna apparatus according to a second embodiment of the present invention;

FIG. 9 is a graph showing a relationship between a frequency and return loss when the length of a stub is varied;

FIG. 10 is an exploded perspective view of an antenna apparatus according to a third embodiment of the present invention;

FIGS. 11A and 11B are exploded perspective views of the antenna apparatus of the present invention illustrating forms of other connecting dielectric strips;

FIG. 12 is a sectional view of the antenna apparatus of the present invention illustrating a form of another nonradiative dielectric waveguide;

DETAILED DESCRIPTION OF EMBODIMENTS OF THE INVENTION

Figure 3:
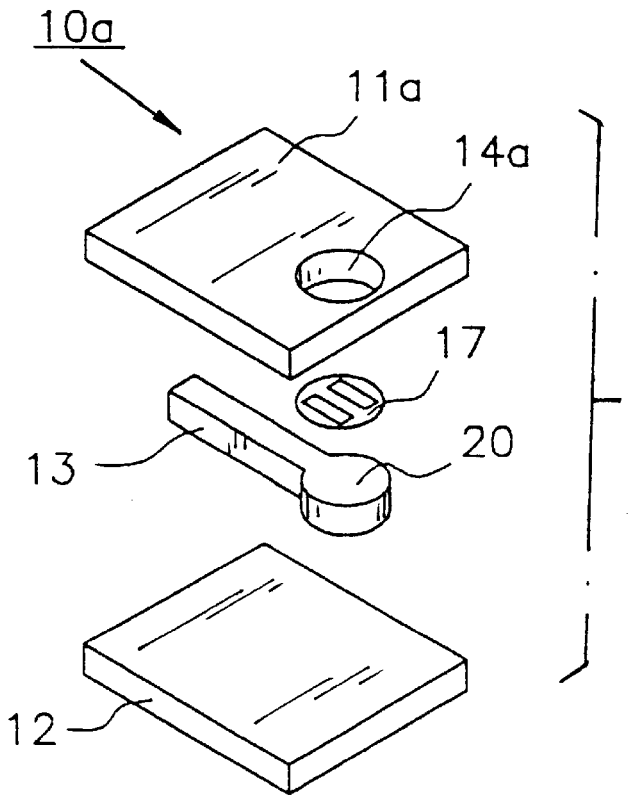
FIG. 3 is an exploded perspective view of the antenna apparatus of the present invention illustrating a form of another aperture.

An antenna apparatus according to a first embodiment of the present invention is described with reference to FIG. 1. FIG. 1 is an exploded perspective view of the antenna apparatus according to this embodiment.

Referring to FIG. 1, an antenna apparatus 10 of this embodiment includes an upper conductor plate 11 and a lower conductor plate 12 prepared by plating aluminum or a dielectric with metal, a dielectric strip 13 made of polytetrafluoroethylene or the like, which is held between the upper conductor plate 11 and the lower conductor plate 12, and a substantially circular matching section 20 integrated with the dielectric strip 13 and continuously connected to one end of the dielectric strip 13. A two-slot aperture 14 is formed on the upper conductor plate 11 at a position where the matching section 20 is disposed.

With this configuration, a nonradiative dielectric waveguide is formed by the upper conductor plate 11, the lower conductor plate 12, and the dielectric strip 13. By adjusting the distance between the upper conductor plate 11 and the lower conductor plate 12 to half a propagating wavelength or less, only the dielectric strip 13 operates as a signal propagation area. An electromagnetic wave input from the outside is propagated through the dielectric strip 13 in an LSM mode, which in turn is connected to the matching section 20. The matching section 20 is suitably shaped in accordance with the operating frequency, thereby matching the impedance between the dielectric strip 13 and the aperture 14. By matching the impedance between the dielectric strip 13 and the aperture 14, the electromagnetic wave is radiated via the aperture 14 on the upper conductor plate 11. Referring to FIG. 2, a casing 15 made of metal is formed in the vicinity of the aperture 14, and a dielectric lens 16 is formed in the upper part of the aperture 14, thereby constructing an antenna 30.

In the antenna apparatus 10 according to this embodiment, the dielectric strip 13 and the matching section 20 are integrated. This eliminates the necessity for detailed working to adjust the distance between a dielectric strip and a dielectric resonator, as in known antenna apparatus, and increases productivity. Characteristics of the antenna apparatus 10 are stable, whereas in the known antenna apparatus, the distance between the dielectric strip and the dielectric resonator varies in accordance with temperature variations, so that the characteristics of the known antenna apparatus are variable.

Figure 4:
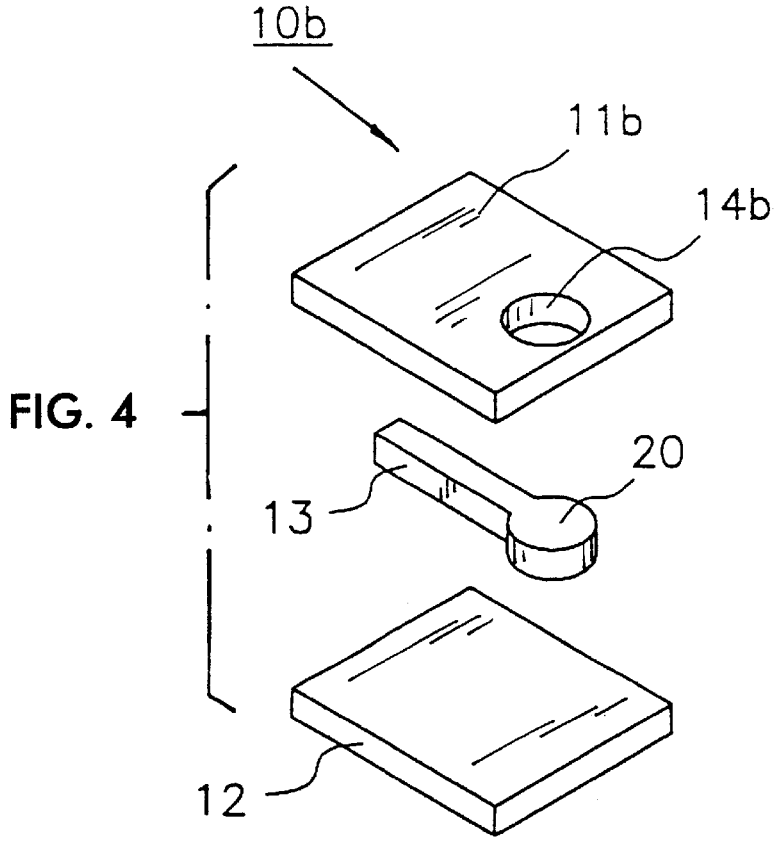
FIG. 4 is an exploded perspective view of the antenna apparatus of the present invention illustrating a form of another aperture.

In the present embodiment, the aperture 14 has two slots. However, other configurations are conceivable as well. Referring to FIG. 3, an antenna apparatus 10*a* is provided with a circular aperture 14*a* on an upper conductor plate 11*a* and a thin metal plate 17 having two slots between the upper conductor plate 11*a* and the matching section 20. Referring to FIG. 4, an antenna apparatus 10*b* simply includes a circular aperture 14*b* on an upper conductor plate 11*b*. In this embodiment, the shape of the matching section 20 is approximately circular. However, the matching section 20 may be of other shapes. Referring to FIGS. 5A and 5B, the shape of the matching section 20 is elliptical. Referring to FIGS. 6A and 6B, the shape of the matching section 20 is rectangular. Referring to FIG. 7, the shape of the matching section 20 is a shape with a hole in the center. Arbitrary variations of the shape of the matching section 20 permit controlling of the directivity of the antenna apparatus.

Referring to FIG. 8, an antenna apparatus according to a second embodiment of the present invention is described. FIG. 8 is an exploded perspective view of the antenna apparatus according to this embodiment. The same numerals as those of the first embodiment are given to the same parts as those of the first embodiment, and a detailed description is omitted.

In an antenna apparatus 10*c* of this embodiment, a stub 18 is formed in the opposite side of the dielectric strip 13 across the matching section 20 and is integrated with the dielectric strip 13 and the matching section 20. By continuously connecting the stub 18 with the matching section 20, reflection characteristics of the antenna apparatus 10*c* are improved.

FIG. 9 is a graph showing return loss when the length of the stub 18 is varied. Referring to FIG. 9, a solid line represents a stub length of 0λg relative to a propagation wavelength of λg, that is, when there is no stub; a chain line represents a stub length of ⅛λg; a dotted line represents a stub length of ¼λg; and a dash-dot line represents a stub length of ⅜λg. As illustrated in FIG. 9, the reflection characteristics are improved when a stub is provided compared to a configuration without a stub, and the best reflection characteristics are obtained when the length of the stub is ¼λg.

With reference to FIG. 10, an antenna apparatus according to a third embodiment of the present invention is described. FIG. 10 is an exploded view of the antenna apparatus according to this embodiment. The same numerals as those of the first embodiment are given to the same parts as those of the first embodiment, and a detailed description is omitted.

Referring to FIG. 10, an antenna apparatus 10*d* of this embodiment includes a connecting dielectric strip 19 whose width is narrower than the dielectric strip 13. The dielectric strip 19 is continuously connected with the matching section 20. With this configuration, an amount of connection between the dielectric strip 13 and the matching section 20 is varied, thereby adjusting the matching, compared with a configuration incorporating a direct connection between the dielectric strip 13 and the matching section 20. Adjusting the length of the connecting dielectric strip 19 to ¼λg relative to the λg propagation wavelength optimizes the matching of the antenna apparatus 10*d*.

Although the connecting dielectric strip 19 of this embodiment is shaped to be narrower in its width, it may be of other shapes, such as a trapezoidal shape, as shown in FIGS. 11A and 11B.

The embodiments described above employ a nonradiative dielectric waveguide prepared by holding a dielectric strip between an upper conductor plate and a lower conductor plate. However, other configurations are conceivable as well. Referring to FIG. 12, the nonradiative dielectric waveguide is prepared by forming a groove 25 at a position where the upper conductor plate 11 and the lower conductor plate 12 oppose each other and fitting the dielectric strip 13 in the groove 25. With this configuration, a longitudinal-section electric (LSE) mode is not activated even when the antenna apparatus includes a bend or the like. This permits the antenna apparatus to activate only the LSM mode which is low-loss.

Figure 13:
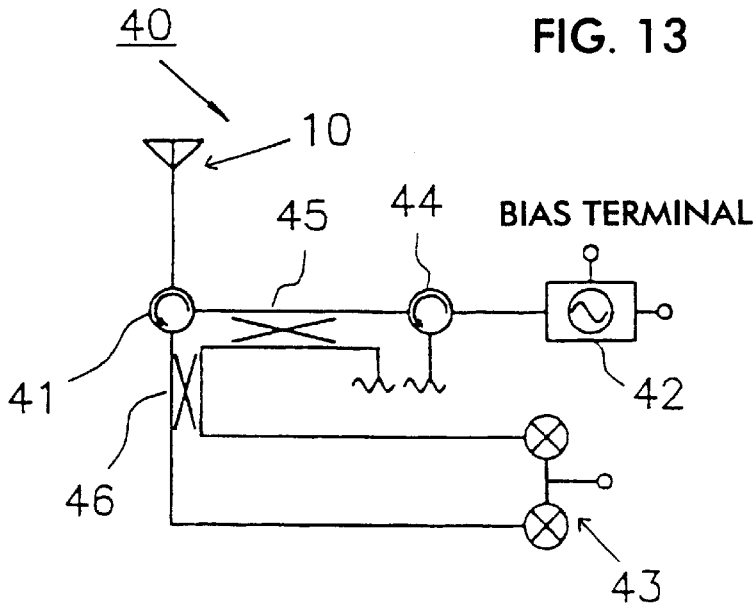
FIG. 13 is a circuit diagram of an equivalent circuit of a transceiver of the present invention.
Figure 14:
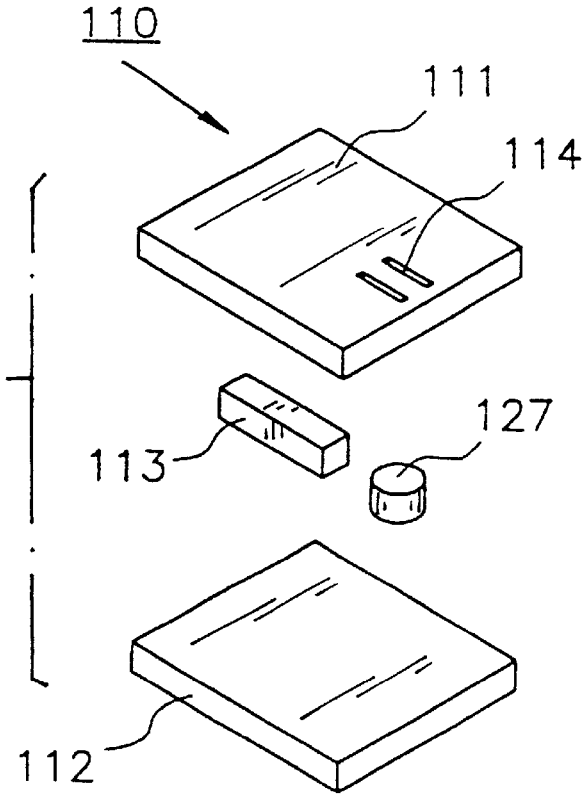
FIG. 14 PRIOR ART
FIG. 14 is an exploded perspective view of a known antenna apparatus.

Next, a transceiver according to an embodiment of the present invention is described with reference to FIG. 13. FIG. 13 is a circuit diagram showing an equivalent circuit of the transceiver of this embodiment.

Referring to FIG. 13, a transceiver 40 of this embodiment includes the antenna apparatus 10, a circulator 41 connected to the antenna apparatus 10, an oscillator 42 connected to one port of the circulator 41, a mixer 43 connected to the other port of the circulator 41, a second circulator connected between the circulator 41 and the oscillator 42, and couplers 45 and 46. In this embodiment, the oscillator 42 is a voltage controlled oscillator, which varies an oscillation frequency by applying a voltage to a bias terminal. The antenna apparatus 10 shown in FIG. 13 is that of the first, second, and third embodiments. The dielectric lens (not shown) is disposed in the radiating direction of the electromagnetic wave. With this configuration, the transceiver 40 propagates a signal from the oscillator 42 via the circulator 44, the coupler 45, and the circulator 41 into the antenna apparatus 10, which in turn is radiated via the dielectric lens. A portion of the signal from the oscillator 42 is supplied as a local signal to the mixer 43 via the couplers 45 and 46. A wave reflected from a target is supplied as a radio frequency (RF) signal to the mixer 43 via the antenna apparatus 10, the circulator 41, and the coupler 46. The mixer 43 as a balanced mixer outputs a differential component between the RF signal and the local signal as an intermediate frequency (IF) signal.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. An antenna apparatus comprising:

two substantially parallel conductors;

a dielectric strip held between said two conductors;

an aperture formed on one of said two conductors in the vicinity of said dielectric strip; and a matching section matching impedance disposed between said dielectric strip and said aperture, said matching section being integrally formed with and connected to said dielectric strip in the vicinity of said aperture.

2. The antenna apparatus of claim 1, wherein a stub made of a dielectric is connected to said matching section.

3. The antenna apparatus of claim 2, wherein the stub has a length of ¼λg where λg represents a propagating wavelength.

4. The antenna apparatus of claim 1, wherein a connecting dielectric strip having a sectional shape differing from that of said dielectric strip is connected to the dielectric strip in the vicinity of said matching section.

5. The antenna apparatus of claim 2, wherein a connecting dielectric strip having a sectional shape differing from that of said dielectric strip is connected to the dielectric strip in the vicinity of said matching section.

6. The antenna apparatus of claim 3, wherein a connecting dielectric strip having a sectional shape differing from that of said dielectric strip is connected to the dielectric strip in the vicinity of said matching section.

7. The antenna apparatus of claim 4, wherein the connecting dielectric strip has a length of ¼λg relative to said propagating wavelength λg.

8. The antenna apparatus of claim 5, wherein the connecting dielectric strip has a length of ¼λg relative to said propagating wavelength λg.

9. The antenna apparatus of claim 6, wherein the connecting dielectric strip has a length of ¼λg relative to said propagating wavelength λg.

10. The antenna apparatus of claim 1, wherein said aperture further comprises a metal plate having an aperture therein disposed between the aperture in one of the conductors and said matching section.

11. The antenna apparatus of claim 1, wherein the matching section has one of a circular, elliptical and rectangular shape.

12. The antenna apparatus of claim 1, wherein the matching section includes an aperture therein.

13. The antenna apparatus of claim 1, wherein the aperture comprises at least one slit.

14. The antenna apparatus of claim 13, wherein the aperture comprises two parallel slits.

15. The antenna apparatus of claim 14, wherein the sectional shape of the connecting dielectric strip is thinner than a sectional shape of the dielectric strip.

16. The antenna apparatus of claim 1, wherein the two conductors have slots therein for receiving the dielectric strip in recessed fashion.

17. An antenna comprising:

an antenna apparatus comprising:

two substantially parallel conductors;

a dielectric strip held between said two conductors;

an aperture formed on one of said two conductors in the vicinity of said dielectric strip; and a matching section matching impedance disposed between said dielectric strip and said aperture, said matching section being integrally formed with and connected to said dielectric strip in the vicinity of said aperture; and a dielectric lens disposed in an upper part of said aperture of said antenna apparatus.

18. The antenna of claim 17, further wherein a stub made of a dielectric is connected to said matching section.

19. The antenna of claim 18, further wherein the stub has a length of ¼λg where λg represents a propagating wavelength.

20. The antenna of claim 19, further wherein a connecting dielectric strip having a sectional shape differing from that of said dielectric strip is connected to the dielectric strip in the vicinity of said matching section.

21. The antenna of claim 20, further wherein the connecting dielectric strip has a length of ¼λg relative to said propagating wavelength λg.

22. A transceiver comprising:

an antenna comprising an antenna apparatus comprising:

two substantially parallel conductors;

a dielectric strip held between said two conductors;

an aperture formed on one of said two conductors in the vicinity of said dielectric strip; and a matching section matching impedance disposed between said dielectric strip and said aperture, said matching section being integrally formed with and connected to said dielectric strip in the vicinity of said aperture;

a dielectric lens disposed in an upper part of said aperture of said antenna apparatus;

and further comprising a transceiver circuit connected to said antenna.

23. The transceiver of claim 22, further wherein a stub made of a dielectric is connected to said matching section.

24. The transceiver of claim 23, further wherein the stub has a length of ¼λg where λg represents a propagating wavelength.

25. The transceiver of claim 24, further wherein a connecting dielectric strip having a sectional shape differing from that of said dielectric strip is connected to the dielectric strip in the vicinity of said matching section.

26. The transceiver of claim 24, further wherein the connecting dielectric strip has a length of ¼λg relative to said propagating wavelength λg.

* * * * *